US007321116B2

(12) United States Patent
Picard et al.

(10) Patent No.: US 7,321,116 B2
(45) Date of Patent: Jan. 22, 2008

(54) IONIZATION SOURCE FOR MASS SPECTROMETER

(75) Inventors: Pierre Picard, Québec (CA); Denis Lessard, Lévis (CA); André L'Heureux, Lévis (CA); Jean Lacoursiere, Sillery (CA); Philippe Nobert, Québec (CA); Sylvain Letarte, Blainville (CA); Alexandre Vallieres, Sainte-Foy (CA); Robert Tiveron, Stoneham (CA); Réal Paquin, Sainte-Foy (CA)

(73) Assignee: Phytronix Technologies, Inc., Quebec (CA)

( * ) Notice: Subject to any disclaimer, the term of this patent is extended or adjusted under 35 U.S.C. 154(b) by 202 days.

(21) Appl. No.: 11/133,896

(22) Filed: May 20, 2005

(65) Prior Publication Data

US 2006/0054807 A1 Mar. 16, 2006

(30) Foreign Application Priority Data

Sep. 15, 2004 (CA) ..... 2,480,549

(51) Int. Cl.
*H01J 49/04* (2006.01)

(52) U.S. Cl. ..... 250/288; 250/287

(58) Field of Classification Search ..... 250/288, 250/287, 282, 281

See application file for complete search history.

(56) References Cited

U.S. PATENT DOCUMENTS 3,478,204 A 11/1969 Brubaker et al.
4,383,171 A 5/1983 Sinha et al.
4,527,059 A 7/1985 Benninghoven et al.
4,740,692 A 4/1988 Yamamoto et al.
5,719,060 A 2/1998 Hutchens et al.
5,742,050 A * 4/1998 Amirav et al. ..... 250/288
5,917,185 A 6/1999 Young et al.
6,040,575 A * 3/2000 Whitehouse et al. ..... 250/288
6,057,543 A * 5/2000 Vestal et al. ..... 250/282
6,288,390 B1 9/2001 Siuzdak et al.
6,573,491 B1 6/2003 Marchitto et al.
6,630,664 B1 10/2003 Syage et al.
6,642,516 B1 11/2003 Hansen et al.
6,683,894 B1 1/2004 Lee et al.
6,747,274 B2 6/2004 Li
6,858,841 B2 * 2/2005 Truche et al. ..... 250/288
7,155,960 B2 * 1/2007 Arii et al. ..... 73/31.05
2004/0245450 A1 12/2004 Hutchens et al.
2005/0056776 A1 * 3/2005 Willoughby et al. ..... 250/281
2005/0098722 A1 * 5/2005 Truche et al. ..... 250/288
2005/0178975 A1 * 8/2005 Glukhoy ..... 250/427

* cited by examiner

*Primary Examiner*—Robert Kim
*Assistant Examiner*—Johnnie L Smith, II
(74) *Attorney, Agent, or Firm*—Darby & Darby PC

(57) ABSTRACT

An apparatus and method for regenerating ion samples for a mass spectrometer are provided. Source samples are loaded on a support which is heated by a laser beam, desorbing the sample without ionization. The desorbed sample is carried by a carrier gas flow through a transfer tube, at the output of which it is ionized by corona discharge or photo-ionization. The obtained ionized sample may be analyzed in a mass spectrometer or used to serve any other appropriate purpose.

45 Claims, 7 Drawing Sheets

IONIZATION SOURCE FOR MASS SPECTROMETER

This application claims priority to Canadian Application No. 2,480,549 filed Sep. 15, 2004, hereby incorporated by reference herein.

FIELD OF THE INVENTION

This invention generally relates to the field of ionization sources, and more specifically concerns an apparatus and method for generating ionized samples through thermal desorption and/or vaporization.

BACKGROUND OF THE INVENTION

Nowadays, a large amount of analyses are carried out by combining high resolution separation techniques and mass spectrometry. This combination of scientific instruments has become important in different domains such as those requiring a high quantity of analyses, due partly to the development of new molecules. This is particularly true for fields such as the pharmaceutical, environmental and proteomic industries.

The coupling of chromatography and mass spectrometry now achieves the highest molecular analysis performance. Different coupling and ionisation techniques have been developed using liquid chromatography and mass spectrometry. One such technique is called Atmospheric Pressure Chemical Ionization (hereinafter APCI). According to this technique, the sample and the mobile phase are first nebulized and dried at atmospheric pressure and then ionized by a corona discharge. One drawback of this technique is the use of a liquid mobile phase which introduces cross-contamination of the samples. Another well-known type of ionization source is called Matrix Assisted Laser Desorption Ionization, or MALDI. In this case, desorption and ionization of a solid state target material are induced simultaneously by heating the sample directly with a laser. The ionization process is carried out at atmospheric pressure or under vacuum via a matrix. Again, cross-contamination is introduced in the sample from the matrix. For both of these techniques, sample preparation and analysis are time consuming and contribute to most of the analysis cost.

In the prior art, various desorption and ionization techniques are found that aim at improving the basic APCI and MALDI approaches described above. For example, U.S. Pat. No. 6,747,274 (LI) discloses a technique employing numerous lasers operating in tandem on samples for increasing the throughput of MALDI-type apparatus. U.S. Pat. No. 6,630,664 (SYAGE et al.) proposes an apparatus for photoionizing a sample that is circulating in an ionization chamber. The sample is ionized by a light source and electrodes direct the ionized sample to a mass spectrometer for analysis. U.S. patent application published under no. 2004/0245450 (HUTCHENS et al.) discloses another MALDI-type system. This technique does not, however, solve the issue of cross-contamination from the matrix. The desirability of having no matrix is actually mentioned by Hutchens, but he does not elaborate on an apparatus or method for enabling such a matrix-free technique.

In U.S. Pat. No. 6,288,390 (SIUZDAK et al.) there is disclosed a method for desorbing and ionizing an analyte, which has been "loaded" onto a porous semi-conductor. Lasers irradiate the analyte-loaded semi-conductor to cause the analyte to desorb and ionize under reduced pressure. The absence of a matrix makes the preparation of each sample analyte less complicated than for the MALDI technique.

In summary, the prior art teaches various techniques for vaporizing and ionizing a sample of a substance, but these techniques are often hampered by extensive and complicated preparation steps, the risk of cross contamination between samples, the need for additional substances for composing the matrix and liquid mobile phase, or other effects of having a matrix or a liquid phase involved in the technique. There is therefore a need for a technique alleviating these drawbacks of the prior art.

SUMMARY OF THE INVENTION

Accordingly, the present invention provides an apparatus for generating an ionized sample. The apparatus includes a heat conductive support adapted to load a source sample thereon. The apparatus also includes heating means for heating the support to cause heating of the source sample, which produces a desorbed sample through desorption of the source sample. A transfer tube is also provided. It has a first end and a second end. The desorbed sample is received at the first end. The transfer tube is provided with a carrier gas flow that flows through the transfer tube and carries the desorbed sample from the first end to the second end. The apparatus also includes ionizing means provided proximate the second end of the transfer tube for ionizing the desorbed sample, to obtain the ionized sample.

The present invention also provides an apparatus for generating a plurality of ionized samples. The apparatus includes a heat conductive support comprising a plurality of sections each adapted to load a source sample thereon. The apparatus also includes heating means for sequentially heating the sections of the support to cause heating of the corresponding source sample to produce a plurality of desorbed samples through desorption of each corresponding source sample. A transfer tube having a first end and a second end is included. The desorbed samples are sequentially received at the first end. The transfer tube is provided with a carrier gas flow therethrough carrying the desorbed samples from the first end to the second end. The apparatus also includes ionizing means provided proximate the second end of the transfer tube for ionizing each of the desorbed samples to obtain the ionized samples.

The present invention also provides a method for generating at least one ionized sample. The method generally includes three steps. First, at least one source sample loaded on a heat conductive support is provided. Second, for each source sample, the conductive support is heated to cause heating of the source sample, and thereby produce a desorbed sample through desorption of the source sample. Third, each desorbed sample is ionized, thereby producing the at least one ionized sample.

The advantages and operation of the invention will become more apparent upon reading the detailed description and referring to the drawings that relate to preferred embodiments of the invention.

Figure 1A:
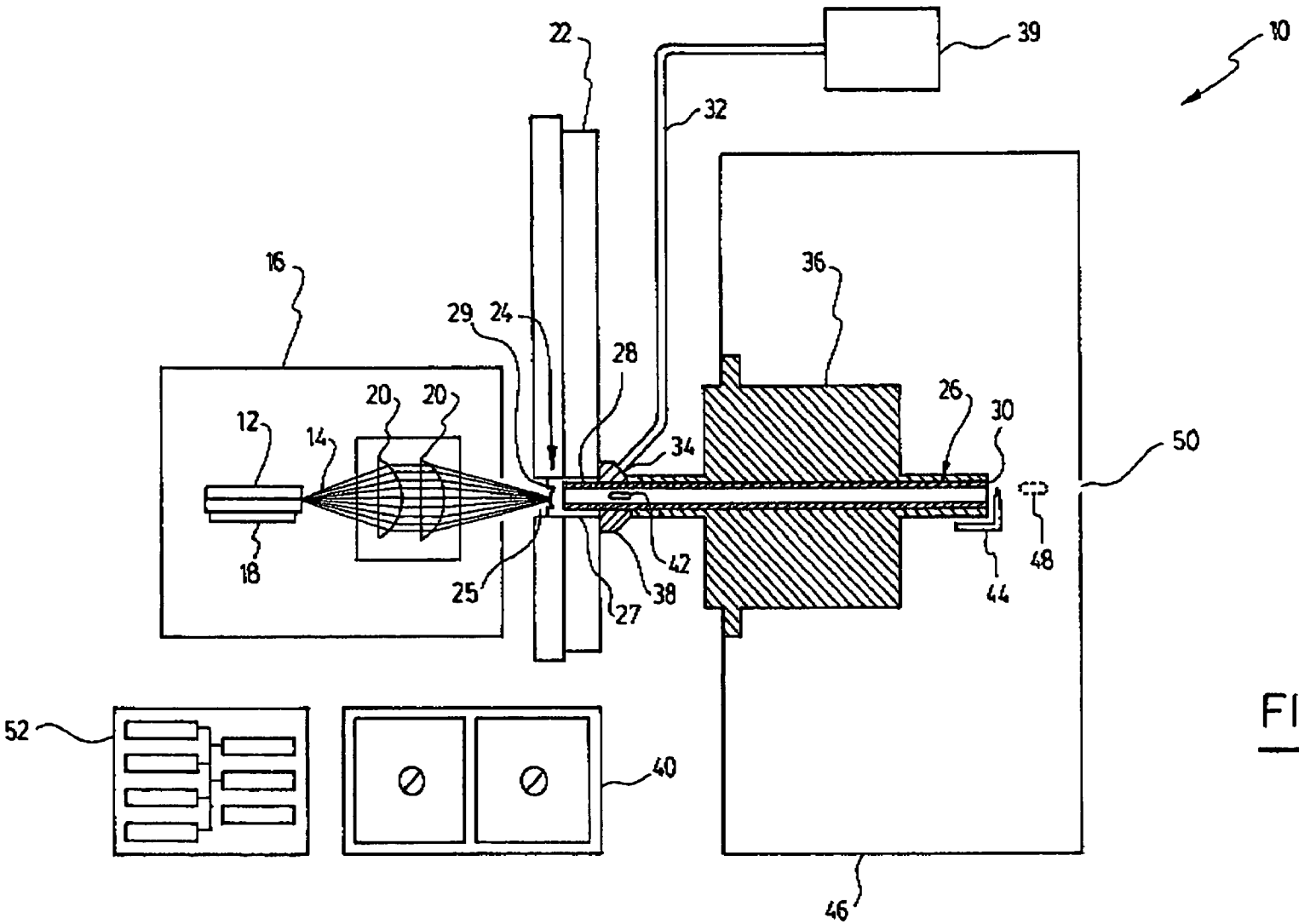
FIGS. 1A and 1B are cross-sectional side views schematically representing ion source apparatuses according to alternative preferred embodiments of the invention.

While the invention will be described in conjunction with example embodiments, it will be understood that it is not intended to limit the scope of the invention to such embodiments. On the contrary, it is intended to cover all alternatives, modifications and equivalents as may be included as defined by the appended claims.

DESCRIPTION OF PREFERRED EMBODIMENTS

In the following description, similar features in the drawings have been given similar reference numerals.

Generally speaking, a new ionization source at atmospheric pressure, preferably interfaced with mass spectrometry, has been developed in response to industry's needs and requests. In its preferred embodiment, the ionization source is based on a process of thermal laser desorption and thus has been named LDTD (Laser Diode Thermal Desorption). Thermal desorption is induced indirectly by a laser beam without a support matrix—unlike the MALDI technique—and ionization is achieved by a corona discharge without liquid mobile phase—unlike the APCI technique. The LDTD technique being matrix and mobile phase free, cross contamination of samples is virtually eliminated.

The present invention first provides an apparatus for generating ionized samples. Although the following description is applied to a system allowing the automated sequential generation of ions from a plurality of samples, it is understood that a simplified apparatus handling a single source sample at a time is also considered to be within the scope of the present invention.

FIG. 1A shows a preferred embodiment of the apparatus (10) for generating ionized samples according to an aspect of the present invention. The apparatus (10) first includes heating means for heating at least one source sample. In this preferred embodiment, the heating means is embodied by a laser source such as a laser diode array (12), generating a radiation beam (14). In the preferred embodiment, the laser diode array (12) preferably emits Infra-red light with a wavelength between 800 and 1040 nm, and preferably about 980 nm, at a power of about 1 to 50 W. The laser diode array (12) is preferably supported by a laser case (16). A Peltier element (18) is advantageously used to stabilize the temperature of the laser diode array (12). If necessary, an optical arrangement for directing and focusing the radiation beam (14) may also be provided, and includes any appropriate optical component apt to focus the radiation beam and direct it to its target. In the illustrated embodiment, the optical arrangement includes two cylindrical lenses (20) (e.g. "Plano Convex Cyl Lens", "B coating": Wavelength 650-1050 nm) disposed in the path of the beam generated by the laser diode array (12).

The apparatus (10) also includes a heat conductive sample support (22), onto which the samples are loaded. The source samples are deposited onto the sample support (22), and may be adsorbed or dried thereon or adhere to the support (22) via other mechanisms. In the preferred embodiment, the support (22) preferably has different sections each provided with a well (24). Each well (24) is adapted to receive a loaded source sample therein, so that heating each well (24) will cause the desorption of the corresponding source sample, producing a corresponding desorbed sample (42). The induced desorption of the loaded source sample implies that the source sample is "unloaded" by desorption and/or vaporization or another release mechanism. Preferably, the support (22) includes a main body made of polypropylene or other insulating material, and each well extends therethrough and has a front end (27) and a back end (25). A sample holder (29), preferably metallic in construction, is inserted inside each well (24) and is adapted for receiving the source samples by the front end (27) of the well (24). As the sample holder (29) in each well is surrounded by plastic, the heat conductive property of the support (22) is therefore to a large extent limited to the well (24) portions alone, and thus the heating of one source sample loaded onto one sample holder (29) does not heat adjacent source samples sufficiently to cause premature desorption of those surrounding samples.

Figure 2C:
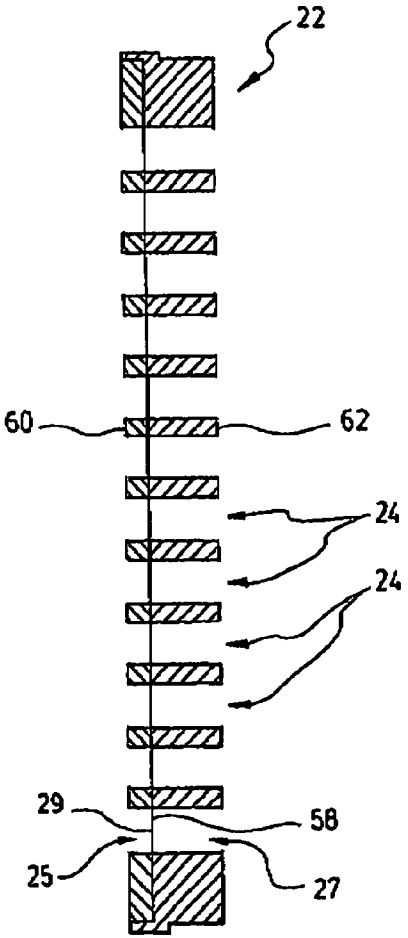
FIGS. 2A, 2B and 2C are cross-sectional side-views of different versions of a heat conductive sample support for use in an apparatus as shown in FIG. 1A or 1B.
Figure 2B:
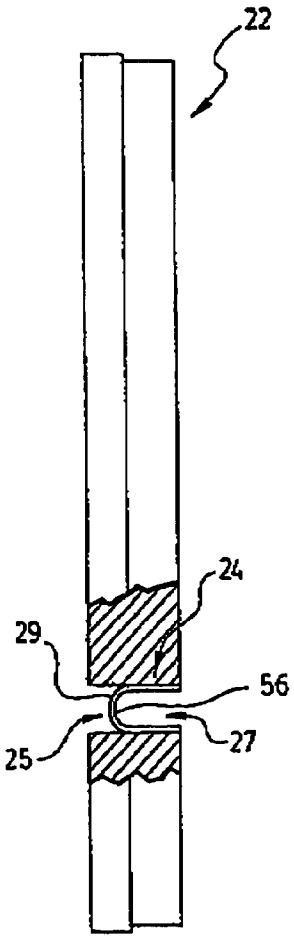
Figure 2A:
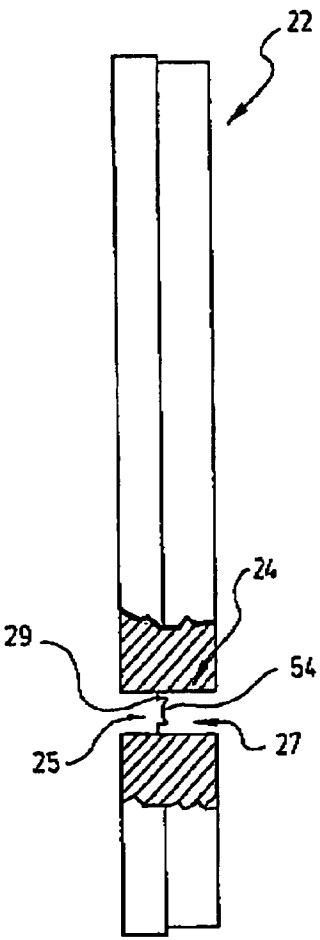

Some preferred shapes of the sample holders (29) are shown in FIGS. 2A, 2B and 2C. In FIG. 2A, the sample holder (29) is embodied by a cup (54) mechanically inserted in the well (24) and extending proximate its back end (25). In the embodiment of FIG. 2B, the sample holder (29) is a cartridge (56) which has also been mechanically inserted in the back end of the well (24). Finally, FIG. 2C shows an alternative embodiment where a metallic sheet (58) is fixed between the two polypropylene plates (60 and 62) forming the main body, the sections of this sheet crossing the wells (24) defining the sample holders (29) for this support (22). The design of the cup (54) or cartridge (56) preferably allows the self-centering of the sample when loaded into the front end (27) of the well (24). The cups (54), cartridge (56) or the metallic sheets (58) are preferably made of chemically inert and conductive materials like stainless steel or aluminium. The wells (24) are also advantageously leak proof and the shape of the cup (54) or cartridge (56) is optimized to achieve an optimum signal. The sample support (22) may contain 96 wells, 384 wells or any other number of wells. As mentioned above, the arrangement and design of the wells (24) and sample holders (29) are preferably such that the source samples are individually heated and desorbed without affecting other samples. However, a person skilled in the art could adapt the support (22) and its components, as well as other elements of the apparatus (10), so that more than one source sample is heated, desorbed and ionized at once.

In a preferred embodiment, a coating (not shown) is deposited on the sample holders (29) prior to loading the source samples thereon. This coating promotes desorption of the source samples and/or improves ionization of the desorbed samples.

In an exemplary realization of the invention, automatic loading and unloading of numerous supports (22) into and out of the rest of the apparatus (10) is achieved by an automatic loader (not shown). For example, 10 supports (22) each having loaded source samples thereon, can be automatically loaded and unloaded one at a time. The support (22) may be advantageously designed with the same standardization criteria (9 mm between the wells, well of 8 mm of diameter) as other similar supports available on the market. This permits the use of any automated preparation system already available on the market.

Referring back to FIG. 1A, it will be noticed that the radiation beam (14) is directed so as to impinge on the back of the heat conductive support (22). More specifically, the radiation beam (14) impinges the support holder (29) from the back end (25) of the corresponding well (24), therefore not directly affecting the source sample which is loaded on the opposite surface of the holder (29). In this manner, the source sample is heated indirectly, unlike with the MALDI technique, and the heating process only acts to desorb the sample without ionizing it. Though partial ionization could occur upon indirectly heating the source sample via the support (22), this would be an exceptional eventuality and complete ionization would be subsequently required.

The apparatus (10) further includes a transfer tube (26) having a first end (28) and a second end (30). The transfer tube (26) is provided with a carrier gas flowing therethrough, which is preferably continuous. The carrier gas is provided by a carrier gas tube (32), which is connected to the first end (28) of the transfer tube (26) via a nozzle (34). The nozzle (34) is arranged and adapted so that the carrier gas is injected into the front end of the well (24) and that the carrier gas flows through the transfer tube (26) from its first end (28) to its second end (30). The nozzle (34) preferably has a flare-shaped portion (38) for abutting on the support (22) when the piston (36) inserts the transfer tube (26) within each well (24). Preferably, the carrier gas is preheated in a gas heater (39) so that its temperature is controlled. The carrier gas may also include a reactive gas for promoting the ionization of the desorbed sample.

The transfer tube (26) is preferably provided with means for sequentially conveying the desorbed samples towards the ionizing means. Preferably, and as shown in FIG. 1A, this is achieved through the use of a piston (36). The transfer tube (26) is sequentially driven by the piston (36) into the wells (24) to collect the desorbed samples (42). The transfer tube (26) may also be heated. More specifically, the piston (36) sequentially longitudinally moves the transfer tube (26) to position its first end (28) within the front end (27) of a well (24). The piston (36) preferably works in coordination with a translation stage (40), which moves the support (22) so that each well (24) is sequentially positioned with its back end (25) in alignment with the radiation beam (14) and its front end (27) in alignment with the transfer tube (26). The translation stage (40) preferably translates the conductive support (22) along orthogonal axes (X-Y) in a plane perpendicular to the radiation beam (14), and in a pre-programmed sequence. Standard or adapted software may be used to this effect. The X-Y translation stage (40) ensures the sequential displacement of the support (22) within a precision of 0.01 mm/cm in both axes. In the preferred embodiment, the displacements are ensured by the action of two stepping motors (51200 steps/rotation, thread pitch of 1 mm) and are controlled by custom designed software. The reproducibility is 0.1 mm for 100 mm displacement. In this way, each source sample can be desorbed and transferred to the second end (30) of the transfer tube (26) to be ionized.

It should be noted that the means for sequentially conveying the desorbed samples (42) from the support (22) to the ionizing means, could take another form readily adapted by someone skilled in the art. The transfer tube (26) may comprise a plurality of entrances for the desorbed samples (42) to enter, and one common exit at the second end (30). Such entrances (not shown) would be open or closed according to which sample holder (29) is being heated. There could also be more than one transfer tube involved in conveying the desorbed sample to be ionized. The piston (36) could also be replaced by other driving means for sequentially driving the transfer tube (26) into the wells (24) of the support (22). These driving means may for example include motors, solenoids, combinations thereof or any other appropriate mechanism apt to move the transfer tube.

Likewise, other embodiments of transfer means could be readily implemented by a skilled worker.

Figure 3:
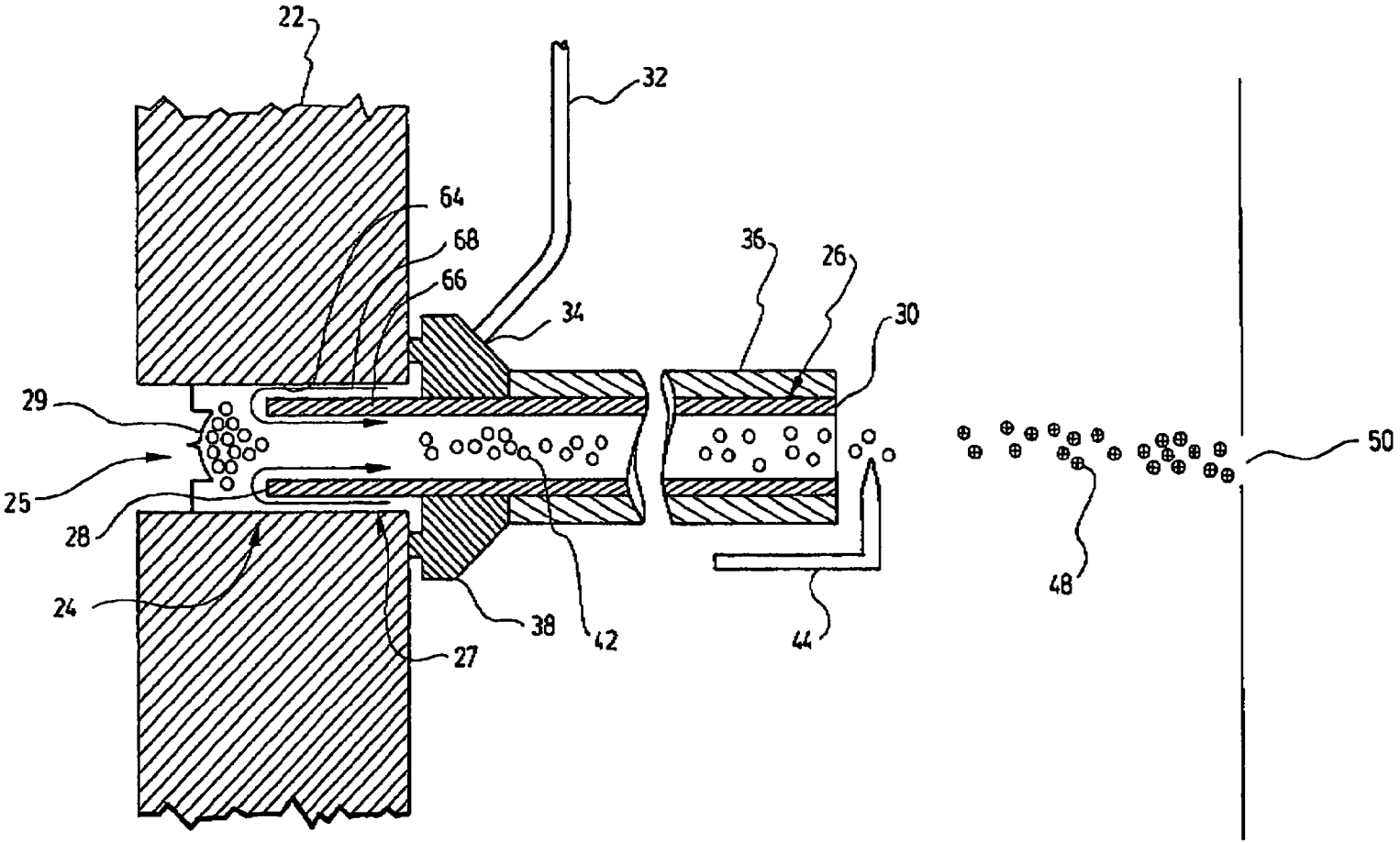
FIG. 3 is a cross-sectional side view of a portion of the apparatus of FIG. 1A, illustrating the molecular flow during the ionization process.

In a first preferred embodiment of the invention, shown in FIGS. 1A and 3, the ionization means preferably include an ionizing needle (44) for generating a corona discharge. The ionizing needle (44) is provided at the exit of the second end (30) of the transfer tube (26). The ionizing needle (44) is preferably made of conductive material such as stainless steel or tungsten. In the preferred embodiment, the ionizing needle (44) is preferably placed perpendicularly, but can also be placed in other orientations, relative to the carrier gas flow exiting the transfer tube (26). The corona discharge (0-10 kV) is carried out through this needle (44) by a process of electronic cascades. The ionizing needle (44) is controlled by constant current mode or by constant voltage mode, and the voltage applied thereto is controlled by the mass spectrometer software or by the electronic control box (52).

Figure 1B:
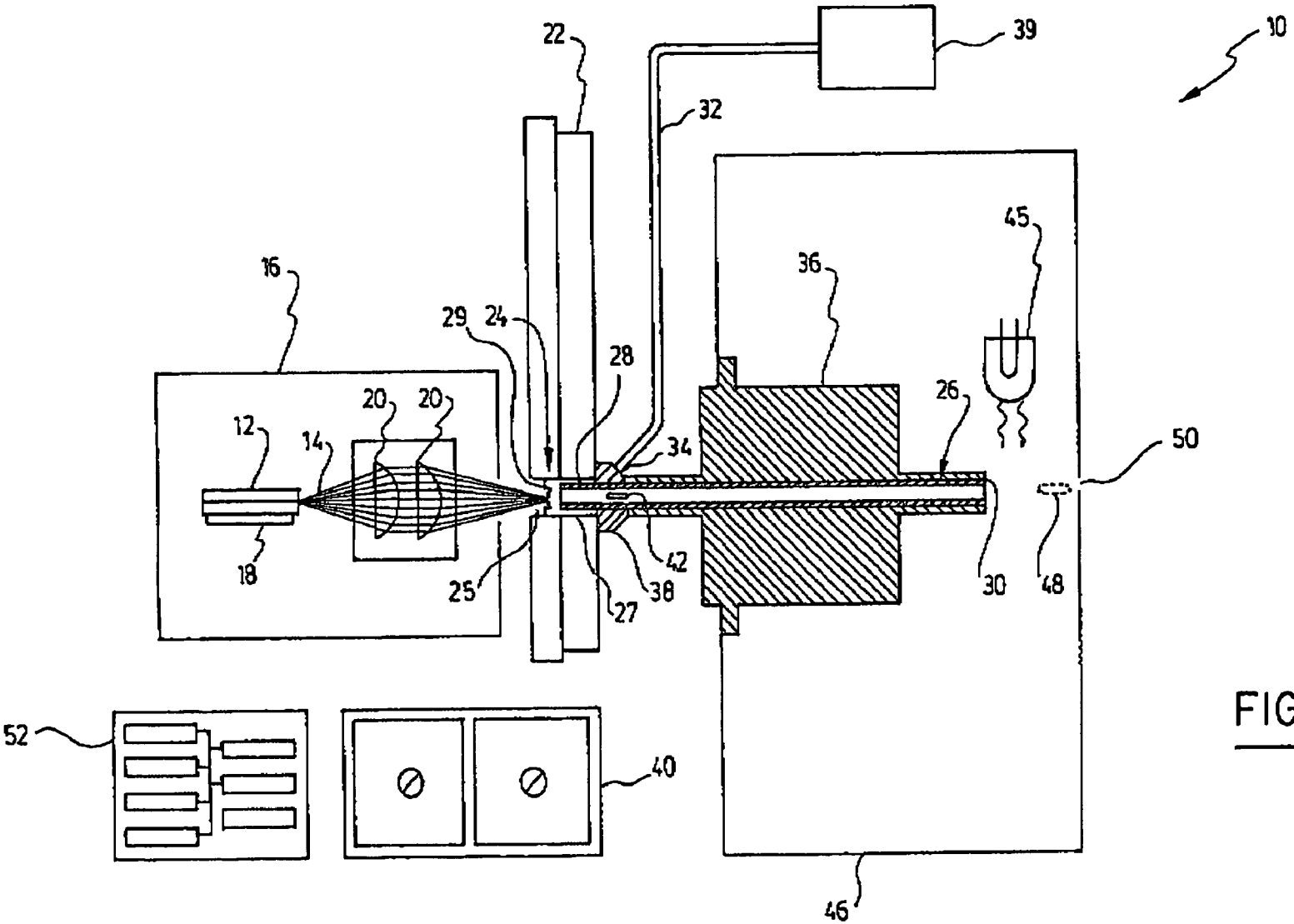

Referring to FIG. 1B, the ionizing means may alternatively or additionally include a UV source (45) for ionizing the desorbed samples through photo-ionization. The UV source (45) is preferably placed perpendicularly, but can also be placed in other orientations, relative to the carrier gas flow outputted at the second end (30) of the transfer tube, as is the ionizing needle (44). In a preferred embodiment, both ionizing techniques are provided and an operator may either choose a single mode of ionization or both modes simultaneously.

FIG. 3 schematically illustrates the desorption and ionisation of a sample. The source sample is loaded onto the sample holder (29), which in this case takes the form of a raised cup (54). The first end (28) of the transfer tube (26) is inserted into the front end (27) of the well (24). The front end (27) of the well (24) has an inner surface (64) and the first end (28) of the transfer tube (26) has an outer surface (66) defining a carrier gas channel (68) between them. Thus the carrier gas flows into the well via the carrier gas channel (68). The source sample is desorbed upon being indirectly heated by the radiation beam (14), and the carrier gas conveys the obtained desorbed sample (42) along the transfer tube (26) from its first end (28) to its second end (30), where it is ionized, thereby generating the ionized sample (48). It is understood that the expression "desorbed sample" refers to a plurality of desorbed molecules of a certain substance, whereas the expression "ionized sample" describes a plurality of ionized molecule of the substance.

Referring again to FIGS. 1A and 1B, the apparatus (10) according to the illustrated embodiment of the invention preferably includes an ionization chamber (46) enclosing the second end (30) of the tube and the needle (44), as well as any other ionizing means. The ionization chamber (46) is purged with an inert gas, such as nitrogen, helium or argon, preferably at atmospheric pressure conditions. In fact, it is an advantageous feature of the present invention that the entire apparatus (10) may be operated under atmospheric pressure conditions. Thus within the ionization chamber (46), each desorbed sample (42) is ionized, thereby producing a corresponding ionized sample (48). The ionization chamber is provided with an outlet orifice (50) through which each ionized sample (48) subsequently exits, and the chamber is well sealed everywhere but at the outlet orifice.

Preferably, the ionized samples exit the outlet orifice (50) and are led to a mass analyser such as a mass spectrometer (not shown). Moreover, the coupling of the LDTD apparatus to different mass spectrometers requires a minimum of mechanical modifications. However, ionized samples could possibly also be brought to other apparatuses or additional processes including ion reactions or other ion analyses.

It is also preferable to regulate the temperature of certain elements of the apparatus (10). In particular, the temperature of the laser diode array (12), the carrier gas and the transfer tube (26) are important parameters for the ionization method. A Peltier element (18) is used for controlling the temperature of the laser diode array (12). The laser diode array (12) is viewed as one unit, which is preferably maintained at a constant temperature by controlling the heat exchange. A gas heater (39) can be used for regulating the temperature of the carrier gas. The transfer tube may be heated or cooled in accordance with process parameters through any appropriate technique as well known in the art.

The elements of the apparatus (10) according to the preferred embodiment shown in FIGS. 1A and 1B are preferably controlled by an electronic control system. This control system is further described in the block diagram in FIG. 4, and is preferably centralized in an electronic control box (52). The control system preferably controls the following elements and variables:

The temperature of the laser diode (via the Peltier element (18))

The current of the laser diode (12)

The ionization needle (44)

The UV source (45)

The automatic loader (AL)

Securities management

Peripheral functions such as the carrier gas flow (within the carrier gas tube (32)), the piston (36), the tube temperature, etc.

The translation stage (40)

The heater controller carrier gas for the gas heater (39)

The communication management

The mass spectrometer (MS)

Figure 4:
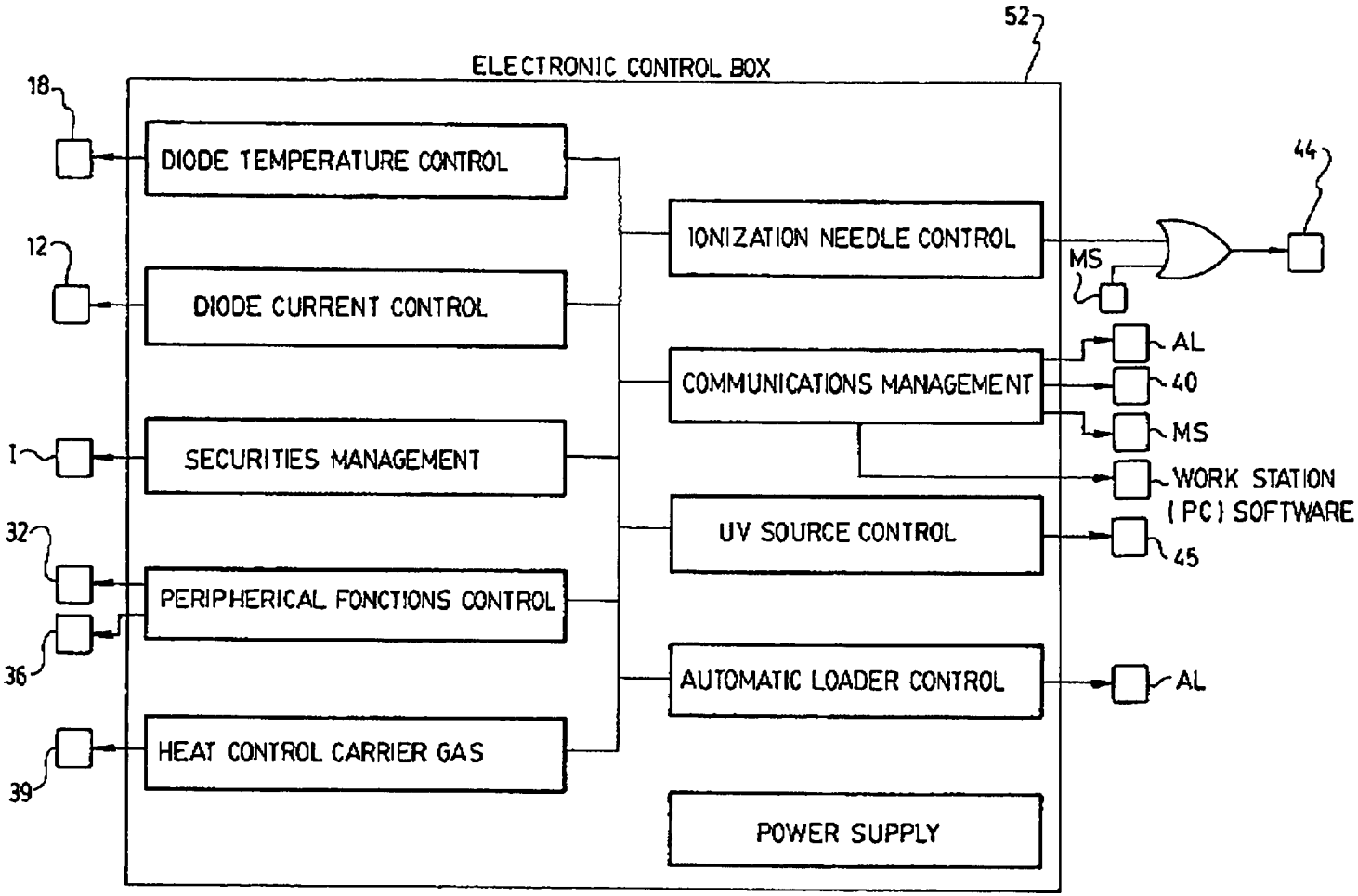
FIG. 4 is a schematic representation of an electronic control circuit for controlling an apparatus as shown in FIG. 1A or 1B.

In another preferred embodiment, the ionizing needle (44) is controlled and triggered by the mass spectrometer (MS) or by the control box (52). This is shown in FIG. 4 by means of an "OR" logic gate.

The control system can also be envisaged to control other peripheral devices and elements that could be added to the apparatus. Notably, in reference to FIGS. 1A and 1B, the Peltier element (18) is used to stabilize the temperature of the laser diode array (12) and is controlled by an electronic circuit located in the electronic control box (52). Also, the translation stage (40) position is pre-programmed according to a desired sequence and controlled by the control box (52). The timing required to coordinate the sequence of events is effectuated by the control system.

Thus, the electronic control box (52) controls the diode current feedback loop, the diode temperature feedback loop (the Peltier element), the communications management, the ionization needle feedback loop, the UV source, the gas temperatures, the peripheral functions like the loader and protections such as high temperatures, diode current trip, opening of the box (52) during operation and also the presence of the support (22). The electronic control box is driven by the adapted software.

According to another aspect of the invention, there is also provided a method for generating ionized samples. This method includes the following steps:

Providing at least one source sample loaded on a heat conductive support. Preferably, each source sample is first prepared using a known technique such as solid phase extraction, chromatography, protein precipitation and capillary electrophoresis. It is then inserted in a front end of a corresponding well provided in the support, each well also having a back end opposite this front end. In practice, the samples are preferably provided on a sample support mechanically loaded into each well.

For each source sample the following steps are then carried out:

sequentially positioning the conductive support so that the back end of each well is sequentially in alignment with a radiation beam;

Longitudinally moving a transfer tube to position a first end thereof within the front end of the corresponding well.

Implementing a pre-desorption delay.

Heating the support to cause heating of the source sample, thereby producing a desorbed sample through desorption of the source sample. This is preferably accomplished by impinging a radiation beam on the back end of the corresponding well. Radiation power is absorbed by the back ends of the sample holders and expressed as a very fast increase in temperature, causing sample desorption. It should be noted that the sample holder is of a material whose heating will cause the sample to desorb therefrom. The support material enables rapid heat transfer to the sample; the sample neither decomposes nor reacts with the support material.

Implementing a post-desorption delay to provide time for the next steps.

Receiving the desorbed sample in the first end of the transfer tube, and providing a carrier gas flow through this tube carrying the desorbed sample from its first end to a second end thereof.

Ionizing the desorbed sample, thereby producing the desired ionized sample. This is preferably achieved through a corona discharge, through photo-ionization of an UV light beam or both.

Inserting the ionized sample into a mass analyser.

Implementing a post-ionization delay before processing the next sample.

Preferably, the steps described here above are conducted under atmospheric pressure conditions. Nevertheless, other pressure levels could be used for any one or all of the steps, by someone skilled in the art adapting the apparatus to suit vacuum or pressurized operating conditions. Such a modification could be due to a specific sample or analyte to be ionized, or other specific process conditions.

The electronic control system preferably controls the timing and other variables (temperature, pressure, gas flows, etc.) of the ionization. The ionisation source is controlled by software that allows the selection of various parameters such as the appropriate current and temperature of the laser diode array. It also allows the determination of the support position, the pre-desorption delay, the desorption delay and the post-desorption delay. Note here that the timing of the pre-desorption and post-desorption delays, as well as other desired delays, are predetermined by the operator. In particular, the post-desorption delay enables ionization and detection by the mass spectrometer to occur before the piston (36) is retracted. Preferably, the parameters (sequence and position of the samples) are imported from the mass spectrometer software in order to synchronize the data acquisition with the laser desorption. This allows the sequencing of a serial execution and therefore ensures repeatability and rapidity of analyses and minimizes the operator's intervention.

Figure 5A:
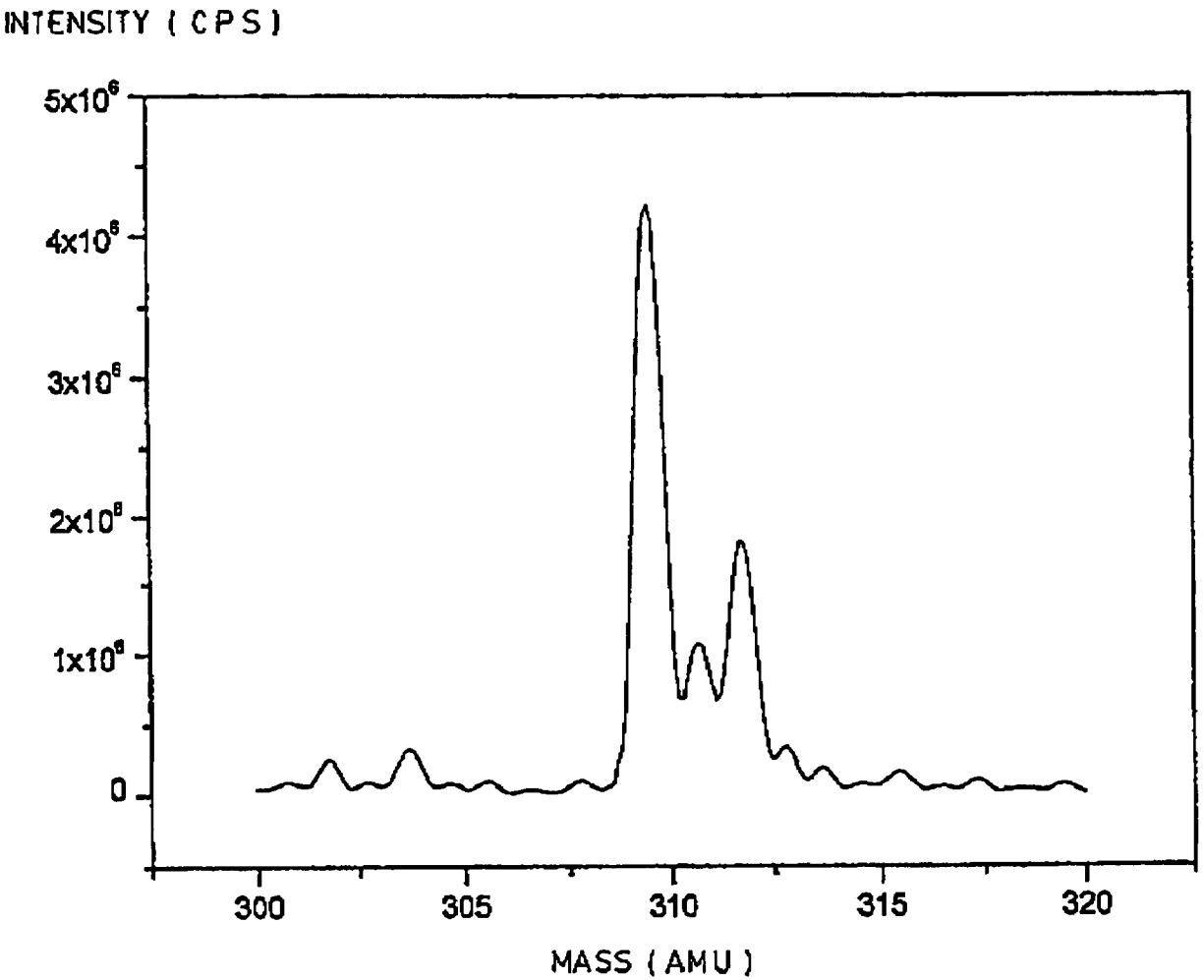
FIGS. 5A and 5B respectively show graphs of a Laser Diode Thermal Desorption Mass Spectrometry (LDTD MS) spectrum and the signal in function of time (XIC) obtained by a mass spectrometer coupled to an ion source apparatus according to the present invention.
Figure 5B:
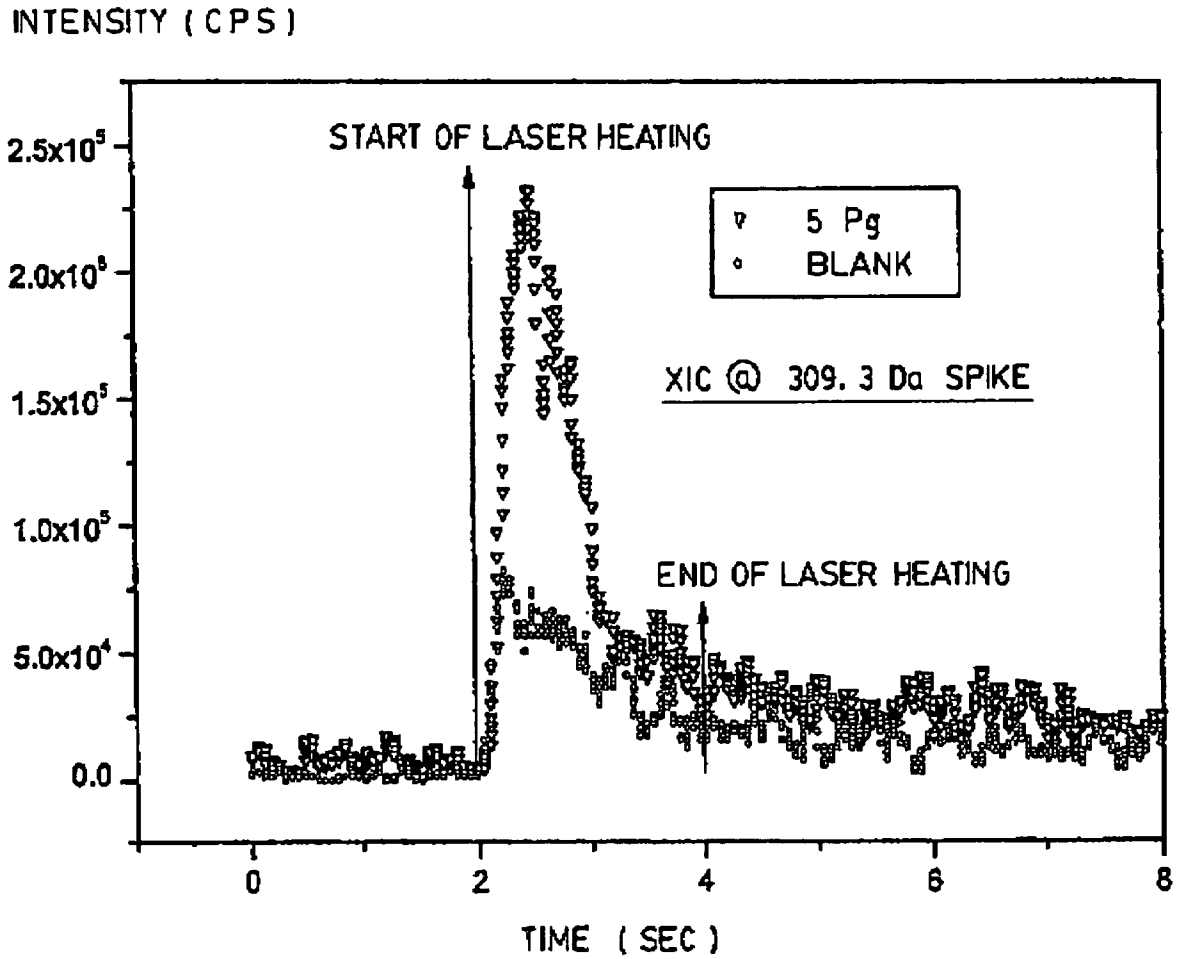

FIG. 5A illustrates results obtained from using the present invention with a LDTD MS spectra of 500 pg of alprazolam injected in the well. The signal of the molecular ion peak at 309.3 Daltons is very intense relative to the mass injected. FIG. 5B is the chromatogram XIC (extract ion chromatogram) of the signal at 309.3 Daltons as a function of time for 5 pg of alprazolam in human plasma. The signal of the analyte (the alprazolam sample) is clearly distinguished from the blank. For both, blank and sample, the preparation was achieved by solid phase extraction (SPE).

In summary, the LDTD apparatus and method manage to reduce desorption duration and thus increase analysis performance. A major breakthrough concerns reducing the desorption duration of the sample to about one second, which is 60 times faster than the usual techniques used in liquid chromatography. A second breakthrough is the absence of solvent (liquid phase or matrix) that allows the direct injection of the sample in its gaseous phase, preferably into the inlet orifice of a mass spectrometer. Such direct injection at an optimal distance increases the sensitivity of the mass spectrometer by a factor of approximately 20 relative to other standard techniques. The LDTD enables the efficient generation of ionized samples and is particularly advantageous for generating ionized analytes for mass spectrometry. Less sample material can be used for high-quality results and the loaded source samples are easily prepared. Thus the processing time and results quality are improved by the current invention.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

What is claimed is:

1. An apparatus for generating an ionized sample, said apparatus comprising:

a heat conductive support adapted to load a source sample thereon, said support having a sample-receiving side and a heat-receiving side;

heating means for heating said heat-receiving side of said support to cause heating through the support toward the sample-receiving side thereof, to cause heating of the source sample, thereby producing a desorbed sample through desorption of the source sample;

a transfer tube having a first end and a second end, said desorbed sample being received at the first end, said transfer tube being provided with a carrier gas flow therethrough carrying said desorbed sample from the first end to said second end; and ionizing means provided proximate the second end of the transfer tube for ionizing said desorbed sample to thereby obtain said ionized sample.

2. The apparatus according to claim 1, wherein the sample-receiving side and the heat-receiving side of the heat conductive support define:

a well having opposite front and back ends; and a sample holder provided within said well for receiving said source sample by the front end of said well, the sample holder being made of an inert material.

3. The apparatus according to claim 2, wherein said sample holder has a shape selected to center the source sample within said well.

4. The apparatus according to claim 2, wherein the heating means comprise a radiation beam impinging on the back end of said well.

5. The apparatus according to claim 4, wherein the heating means further comprise a laser source generating said radiation beam.

6. The apparatus according the claim 5, wherein the laser source comprises a laser diode array.

7. The apparatus according to claim 6, wherein the heating means further comprise an optical arrangement directing and focusing the radiation beam onto the sample holder through the back end of said well.

8. The apparatus according to claim 2, further comprising a piston for longitudinally moving said transfer tube to position the first end thereof within the front end of said well to receive the desorbed sample.

9. The apparatus according to claim 8, wherein the front end of the well has an inner surface and the first end of the transfer tube has an outer surface defining a carrier gas channel therebetween when the transfer tube is positioned within the front end of said well.

10. The apparatus according to claim 9, further comprising a carrier gas nozzle uniformly injecting a carrier gas within said carrier gas channel to generate said carrier gas flow.

11. The apparatus according to claim 10, wherein the nozzle has a flare-shaped portion abutting on the support upon positioning of said first end of the transfer tube within the front end of the well.

12. The apparatus according to claim 11, further comprising a gas heater for regulating the temperature of the carrier gas flow.

13. The apparatus according to claim 1, wherein said carrier gas flow includes a reactive gas for promoting ionization of the desorbed sample.

14. The apparatus according to claim 1, wherein the ionizing means comprise an ionizing needle generating a corona discharge.

15. The apparatus according to claim 1, wherein the ionizing means comprise an ultraviolet light source generating a light beam adapted to ionize said desorbed sample by photo-ionization.

16. The apparatus according to claim 1, further comprising an ionization chamber enclosing said second end of the transfer tube and the ionizing means.

17. The apparatus according to claim 16, wherein the ionization chamber is purged with an inert gas.

18. The apparatus according to claim 1, wherein said support and said transfer tube are maintained under atmospheric pressure conditions.

19. An apparatus for generating a plurality of ionized samples, said apparatus comprising:

a heat conductive support comprising a plurality of sections each adapted to load a source sample thereon and each having a sample-receiving side and a heat-receiving side;

heating means for sequentially heating said heat-receiving side of each of said sections of the support to cause heating through the support toward the corresponding sample-receiving side of each of said sections, to cause heating of the corresponding source sample, thereby producing a plurality of desorbed samples through desorption of each corresponding source sample;

a transfer tube having a first end and a second end, said samples being sequentially received at the first end, said transfer tube being provided with a carrier gas flow therethrough carrying said desorbed samples from the first end to the second end; and ionizing means provided proximate the second end of the transfer tube for ionizing each of said desorbed samples to thereby obtain said ionized samples.

20. The apparatus according to claim 19, wherein the sample-receiving side and the heat-receiving side of each section of the heat conductive support define:

a well having opposite front and back ends; and a sample holder provided within said well for receiving a corresponding source sample by the front end of said well, the sample holder being made of an inert material.

21. The apparatus according to claim 20, wherein the heating means comprise:

a radiation beam for sequentially impinging on the back end of each well; and a laser source generating said radiation beam.

22. The apparatus according to claim 21, wherein the laser source comprises a laser diode array.

23. The apparatus according to claim 21, further comprising a translation stage for sequentially positioning the conductive support so that the back end of each well is sequentially in alignment with said radiation beam.

24. The apparatus according to claim 23, wherein the translation stage translates the conductive support in a pre-programmed sequence.

25. The apparatus according to claim 23, wherein the translation stage translates the conductive support along orthogonal axes in a plane perpendicular to said radiation beam.

26. The apparatus according to claim 25, further comprising a piston for sequentially longitudinally moving the transfer tube to position the first end thereof within the front end of each well to receive the corresponding desorbed sample.

27. The apparatus according to claim 26, further comprising an electronic control system for controlling:

the translation stage;

the laser source;

the piston;

the carrier gas temperature; and the ionization means.

28. The apparatus according to claim 19, wherein the ionizing means comprise an ionizing needle generating a corona discharge.

29. The apparatus according to claim 19, wherein the ionizing means comprise an ultraviolet light source generating a light beam adapted to ionize said sample by photo-ionization.

30. A method for generating at least one ionized sample, said method comprising the steps of:

a) providing at least one source sample loaded on a heat conductive support, said support having a sample-receiving side and a heat-receiving side; and for each of said source sample:

b) heating said heat-receiving side of the said support to cause heating through the support toward the sample-receiving side thereof, to cause heating of the source sample, thereby producing a desorbed sample through desorption of the source sample;

c) ionizing said desorbed sample, thereby producing said at least one ionized sample.

31. The method according to claim 30, wherein step a) comprises the substeps of:

i. preparing each of said at least one source sample;

ii. inserting each of said at least one source sample in a front end of a corresponding well defined by the sample-receiving and heat-receiving sides of said support, each well also having a back end opposite said front end.

32. The method according to claim 30, wherein the preparing of substep a) i. comprises using a technique selected from the group consisting of solid phase extraction, protein precipitation, chromatography and capillary electrophoresis.

33. The method according to claim 31, comprising a step between steps a) and b) of sequentially positioning the conductive support so that the back end of each well is sequentially in alignment with a radiation beam.

34. The method according to claim 33, comprising an additional step before step b) for each source sample of longitudinally moving a transfer tube to position a first end thereof within the front end of the corresponding well.

35. The method according to claim 34, comprising an additional step before step b) for each source sample of implementing a pre-desorption delay.

36. The method according to claim 34, wherein step b) comprises impinging a radiation beam on the back end of the corresponding well.

37. The method according to claim 36, comprising an additional step between steps b) and c) of:

receiving said desorbed sample in the first end of the transfer tube, and providing a carrier gas flow through said transfer tube carrying said desorbed sample from the first end of said transfer tube to a second end thereof.

38. The method according to claim 30, wherein the ionizing of step c) is achieved by a corona discharge.

39. The method according to claim 30, wherein the ionizing of step c) is achieved by photo-ionization of an ultraviolet light beam.

40. The method according to claim 30, comprising an additional step after step c) for each ionized sample of implementing a post-desorption delay.

41. The method according to claim 30, comprising an additional step after step c) for each ionized sample of inserting said at least one ionized sample into a mass analyser.

42. The method according to claim 30, wherein all of said steps are performed at atmospheric pressure.

43. The apparatus according to claim 1, wherein the sample-receiving side and the heat-receiving side are opposite each other.

44. The apparatus according to claim 19, wherein the sample-receiving side and the heat-receiving side are opposite each other.

45. The method according to claim 30, wherein the sample-receiving side and the heat-receiving side are opposite each other.

* * * * *